United States Patent [19]

Gungle et al.

[11] 4,056,751

[45] Nov. 1, 1977

[54] METAL HALIDE DISCHARGE LAMP HAVING OPTIMUM ELECTRODE LOCATION

[75] Inventors: W. Calvin Gungle, Danvers, Mass.; Federic Koury, Alexandria, N.H.; William M. Keeffe, Rockport, Mass.

[73] Assignee: GTE Sylvania Incorporated, Danvers, Mass.

[21] Appl. No.: 669,055

[22] Filed: Mar. 22, 1976

[51] Int. Cl.[2] ..... H01J 61/20

[52] U.S. Cl. ..... 313/217; 313/220; 313/229

[58] Field of Search ..... 313/217, 220

[56] References Cited

U.S. PATENT DOCUMENTS

| | | | |
|---|---|---|---|
| 2,568,459 | 9/1951 | Noel | 313/220 |
| 3,350,598 | 10/1967 | Corbin et al. | 313/220 |
| 3,858,078 | 12/1974 | Koury | 313/220 |
| 3,878,419 | 4/1975 | Lafiandra | 313/220 X |
| 4,001,623 | 1/1977 | Howles et al. | 313/217 X |

*Primary Examiner*—Rudolph V. Rolinec
*Assistant Examiner*—Darwin R. Hostetter
*Attorney, Agent, or Firm*—James Theodosopoulos

[57] ABSTRACT

In a metal halide arc discharge lamp having an arched arc tube with an electrode at each end thereof, each electrode is located about midway between the arc tube lower wall and the axis of the arc tube.

1 Claim, 1 Drawing Figure

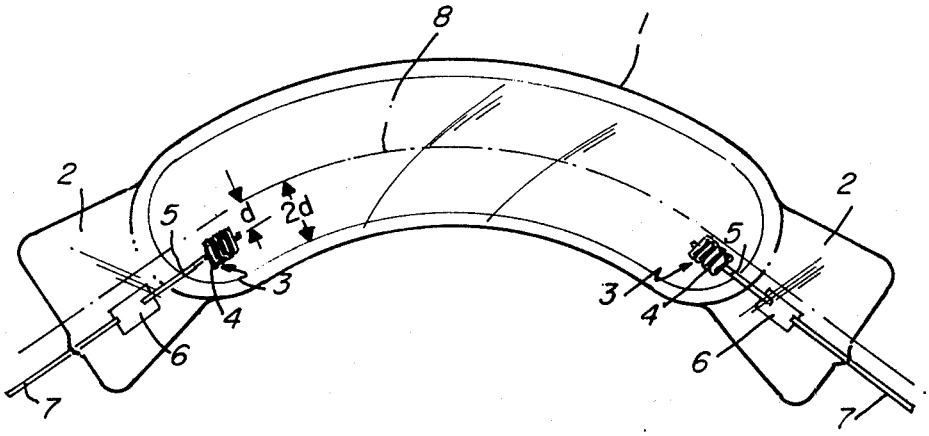
8
1
2
2
5
5
d
2d
3
3
4
4
6
6
7
7

METAL HALIDE DISCHARGE LAMP HAVING OPTIMUM ELECTRODE LOCATION

THE INVENTION

This invention concerns high intensity arc discharge lamps. It particularly relates to metal halide lamps having an arched arc tube. Such lamps are shown in U.S. Pat. No. 3,858,078, the disclosure of which is incorporated herein by reference.

In such a lamp, the arc tube is generally made of high silica glass, for example, fused quartz, has an electrode at each end and contains a fill including mercury, metal halide and an inert gas. The lamp is made for horizontal operation, arch uppermost, and the arc tube is arched to substantially conform to the shape of the arc discharge during operation.

We have found that improved lamp operation is obtained when the electrodes are located about midway between the lower wall of the end cavity of the arc tube and the axis of the arc tube.

The single FIGURE in the drawing is an elevational view of an arc tube in accordance with this invention.

As shown in the drawing, one embodiment of an arched arc tube 1 in accordance with this invention has press seals 2 and electrodes 3 at each end thereof. Electrode 3 can be the usual type of electrode used in metal halide arc discharge lamps, namely, a tungsten coil 4 mounted on a thoriated tungsten rod 5. One end of rod 5 is embedded in press seal 2 and is connected therewithin to a molybdenum ribbon 6 which is connected to external lead-in wire 7.

The axis of the arc tube is indicated by broken line 8. The distance from axis 8 to the arc tube wall is shown as 2*d.* Each electrode 3 is located about midway between axis 8 and the lower arc tube wall, that is, a distance of about *d* from either.

The advantage of such a location for the electrode is that, during operation, the hot electrode heats the end cavity of the arc tube substantially uniformly so as to minimize condensation of the metal halides thereat, without being so close to the arc tube wall as to cause devitrification of the quartz or as to promote reaction between the metal halides and the quartz.

In a comparison of 175 watt metal halide arc lamps, group A of which had each electrode located at the axis of the arched arc tube and Group B of which had the electrodes located in accordance with this invention, the 100 hour light output of the Group A lamps was only 14,200 lumens as against 16,800 lumens for the Group B lamps, an improvement of 18% for the lamps as per this invention. The respective 500 hour maintenance figures were 81% and 87%, also a significant improvement.

The same comparison made on 400 watt arch lamps showed similar improvements. The initial light output for the two groups were 34,300 and 36,300 lumens respectively, an improvement of about 6%. The 1000 hour maintenance average for the lamps having the electrodes at the arc tube axis was 84%; for the lamps having electrodes located in accordance with this invention, the maintenance average was 94%.

We claim:

1. In a metal halide arc discharge lamp having an arched arc tube containing a fill of mercury, metal halide and inert gas and having electrodes sealed in each end of the arc tube and wherein the arc tube is normally operated in a horizontal position with the arch uppermost, the improvement which comprises the electrodes being located about midway between the arc tube axis and the lower wall of the arc tube.

* * * * *